US011109720B2

(12) United States Patent
Lin

(10) Patent No.: US 11,109,720 B2
(45) Date of Patent: Sep. 7, 2021

(54) ELASTIC SOAP CONTAINER SLEEVE

(71) Applicant: Yu Lin, McLean, VA (US)

(72) Inventor: Yu Lin, McLean, VA (US)

( * ) Notice: Subject to any disclaimer, the term of this patent is extended or adjusted under 35 U.S.C. 154(b) by 0 days.

(21) Appl. No.: 16/817,097

(22) Filed: Mar. 12, 2020

(65) Prior Publication Data

US 2020/0288918 A1 Sep. 17, 2020

Related U.S. Application Data

(60) Provisional application No. 62/817,734, filed on Mar. 13, 2019.

(51) Int. Cl.
*A47K 7/02* (2006.01)
*A47K 7/03* (2006.01)
*A47K 7/04* (2006.01)

(52) U.S. Cl.
CPC ..... *A47K 7/03* (2013.01); *A47K 7/04* (2013.01); *A47K 7/043* (2013.01)

(58) Field of Classification Search
CPC ..... A47K 7/03; A47K 7/04; A47K 7/043
USPC ..... 401/201
See application file for complete search history.

(56) References Cited

U.S. PATENT DOCUMENTS 4,618,443 A * 10/1986 Jude ..... A47K 7/03 15/104.94
6,318,922 B1 * 11/2001 Briggs ..... A47K 7/03 206/77.1
8,142,095 B1 * 3/2012 Cutler ..... A47K 7/03 401/201
10,893,744 B2 * 1/2021 Lopiccolo ..... A46B 11/0086
2018/0263430 A1 * 9/2018 Terfous ..... A47K 5/03

FOREIGN PATENT DOCUMENTS

TW M575319 U * 3/2019 ..... A47K 7/04

* cited by examiner

*Primary Examiner* — Jennifer C Chiang
(74) *Attorney, Agent, or Firm* — Melvin K. Silverman

(57) ABSTRACT

An elastic sleeve method and apparatus for use with a bar of soap to limit the surface area of the soap that is exposed, and reduce the rate of shrinkage of the bar of soap. The sleeve comprises a container of elastic material having a top, bottom, and an elastic opening for insertion of a soap cake. The elastic material has form-fitting dimensions adaptable to the shape of an underlying soap cake. The elastic material also has a plurality of apertures to provide atmospheric communication through the elastic sleeve to an inserted soap cake's surface.

6 Claims, 8 Drawing Sheets

ELASTIC SOAP CONTAINER SLEEVE

REFERENCE TO RELATED APPLICATION

This application claims the benefit under 35 USC 119(e) of the U.S. provisional patent application Ser. No. 62/817,734, filed Mar. 13, 2019.

FIELD OF INVENTION

The present invention relates to containment devices for bars of soap.

BACKGROUND OF THE INVENTION

An issue arises when a bar of soap is used. Typically the surface area of a bar is in excess of what is necessary to provide an adequate amount of soap for cleaning purposes. As a result, the bar of soap will diminish faster than it needs to. No devices currently available provide an adaptable sleeve that has the ability to contract as a bar of soap shrinks. There are containers on the market for soap, but these are typically made of plastic and only for the transportation of soap, such as in a travel or toiletry bad. Flexible soap containers may be in the form of mesh or fabric bags, but these do not have the ability to shrink as the soap diminishes, leaving a container that is mainly used for exfoliation purposes because the entire bar of soap is still exposed to liquid that flows through the mesh or fabric. Further, all soap containers fall short of allowing for suds and exfoliation, while at the same time reducing the amount of surface area in any meaningful way as the invention herein.

SUMMARY OF THE INVENTION

The instant invention is for an elastic sleeve for use with a bar of soap to limit the surface area of the soap that is exposed, and reduce the rate of shrinkage of the bar of soap. The sleeve comprises a container of elastic material having a top, bottom, and an elastic opening for insertion of a soap cake. The elastic material has form-fitting dimensions adaptable to the shape of an underlying soap cake, capable of expansion to accommodate higher volume soap cakes. The material is also contractible, while keeping a form-fitting tight periphery to the soap cake to stop surface contact with water where the elastic material does not have an aperture. The elastic material also has a plurality of apertures to provide atmospheric communication through the elastic sleeve to a limited area of the inserted soap cake's surface.

Further provided is the elastic material comprised of silicone.

Additionally provided is the top and bottom having a plurality of apertures existing on both top and bottom surfaces that allow water to interact with the soap cake's surface, but the apertures are resilient enough to flex but not tear.

It is an object of this invention to provide a sleeve for soap bars to reduce the surface area exposed and limit the rate of shrinkage of a bar of soap.

It is yet another object to provide a containment sleeve that is expandable and contractible to allow the sleeve to adapt to dimensions of the underlying bar of soap.

It is accordingly an object to provide a sleeve which may be easily gripped by the hand of a user.

The above and yet other objects and advantages of the invention will become apparent from the hereinafter set forth Brief Description of the Drawings, Detailed Description of the Invention, and Claims appended herewith.

DETAILED DESCRIPTION OF THE INVENTION

Figure 1:
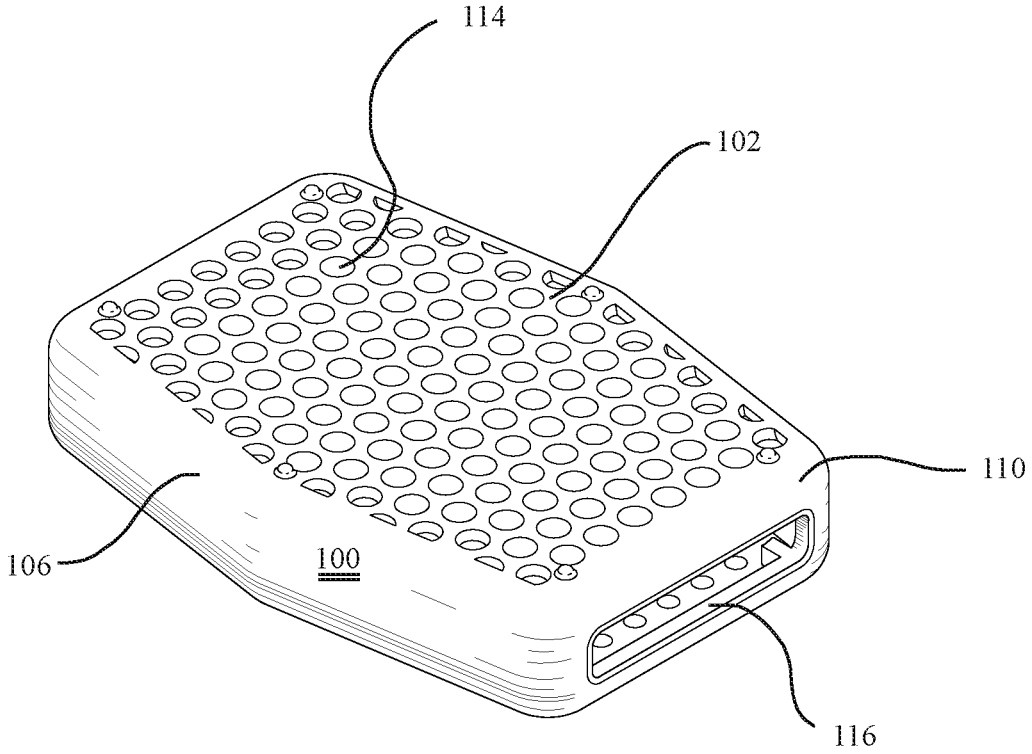
FIG. 1 is an isometric view of the elastic soap sleeve.
Figure 2:
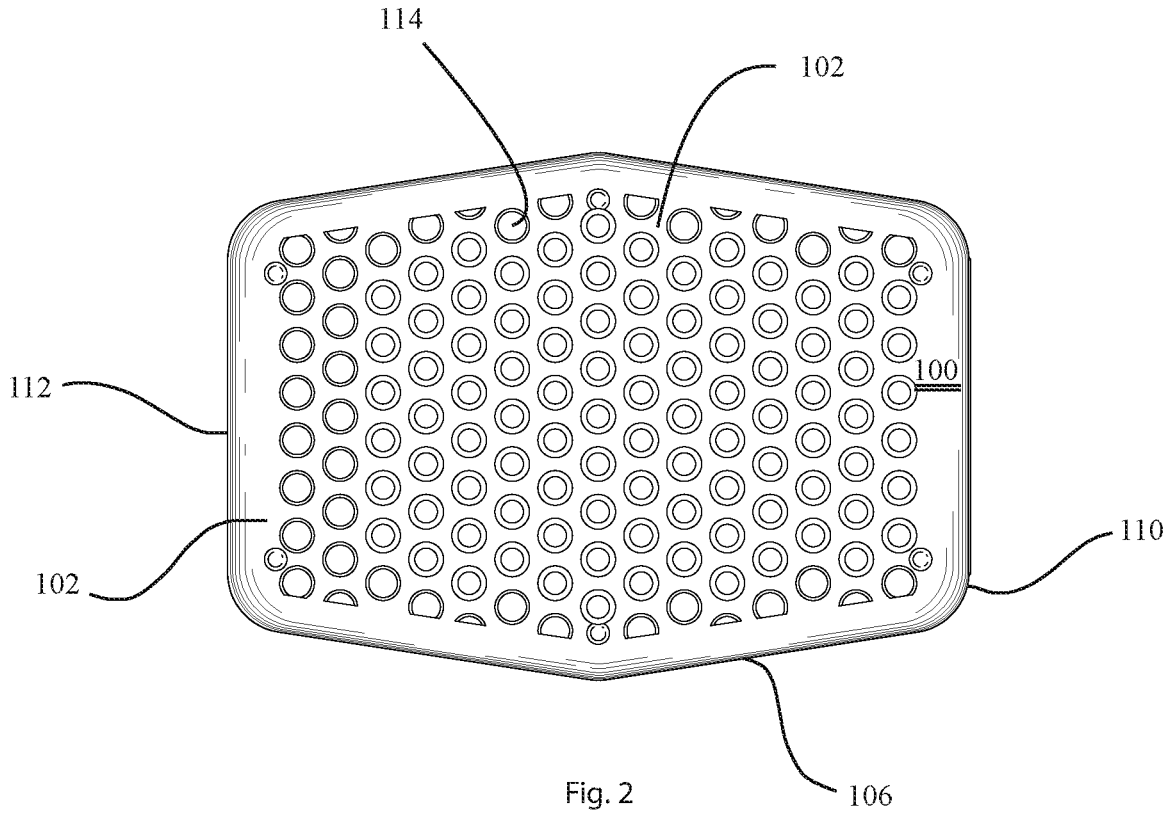
FIG. 2 is a top view of the soap sleeve of FIG. 1.

The instant invention provides a sleeve 100 for containing a soap cake, such as a bar of soap, to limit the exposure of the surface area of such a soap cake, and in the case of soap, reduce the amount of water hitting and reacting with the soap to reduce the rate of soap runoff during cleaning, and to limit the rate of shrinkage of a bar of soap during cleaning. This is done by employing form-fitting elastic water-resistant material with resilient apertures 114 that can flex and contract to provide a tight, form-fitting periphery around a soap cake so that the soap cake does not get wet beyond the areas exposed to the aperture 114.

The invention is comprised of an elastic material, ideally silicone, which can expand and contract to adapt to the size of the soap cake placed inside. The invention is ideally molded into a single silicone case, with apertures 114 either created in the silicone's mold, or cut out after the container 100 has been created. An elastic opening 116 allows for a bar of soap to be inserted in to the container 100, but provides resistance for the soap to avoid the soap falling out.

Figure 3:
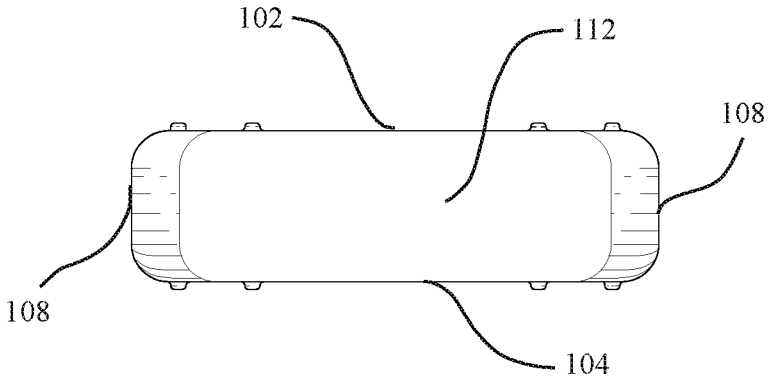
FIG. 3 is a rear view of the soap sleeve of FIG. 1.
Figure 4:
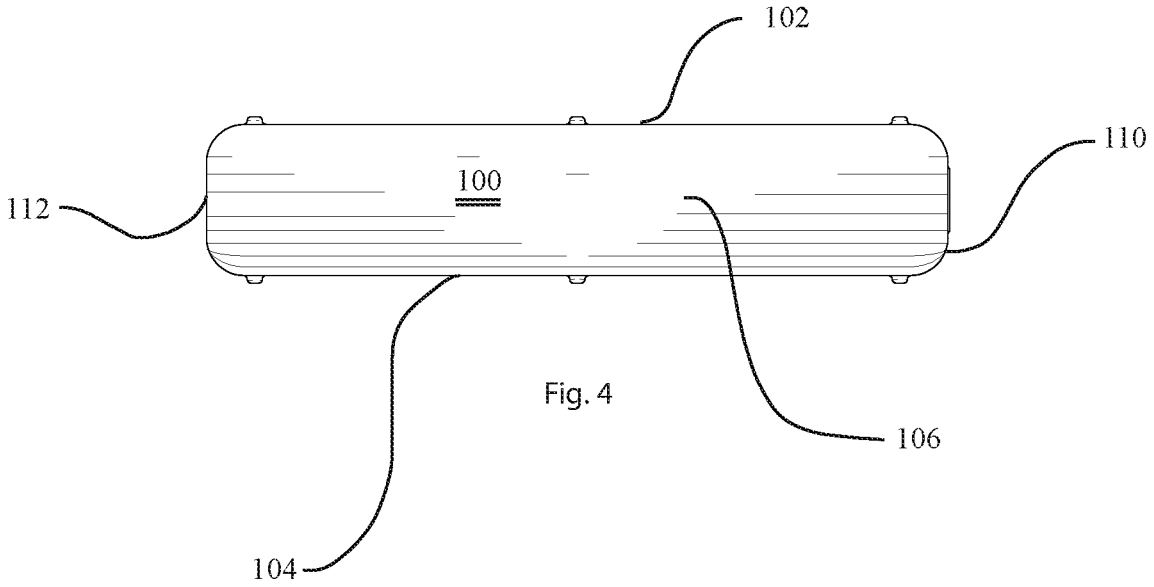
FIG. 4 is a side view of the soap sleeve of FIG. 1.
Figure 5:
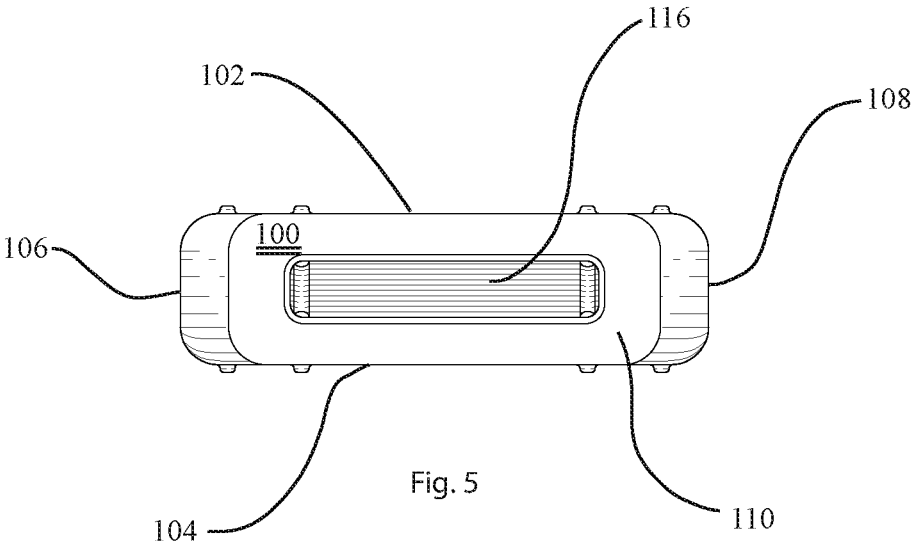
FIG. 5 is a front view of the soap sleeve of FIG. 1.

Shown in FIGS. 1-8 is the soap sleeve 100. The sleeve 100 is comprised of a top 102 shown in FIG. 2, a bottom 104 shown in FIG. 7, and sides 106 and 108, as may be seen from FIGS. 4 and 8 respectively. Sides 106 and 108 connect the top 102 to the bottom 104. Front 110 and back 112 are also shown in FIGS. 5 and 3 respectively, as well as in the isometric views of FIG. 1.

As seen in FIGS. 1, 2, 6, and 7, apertures 114 can be seen on the top 102 as well as the bottom 104 of the container 100. These apertures 114 provide the atmospheric communication for a soap cake placed inside the container sleeve 100.

Figure 6:
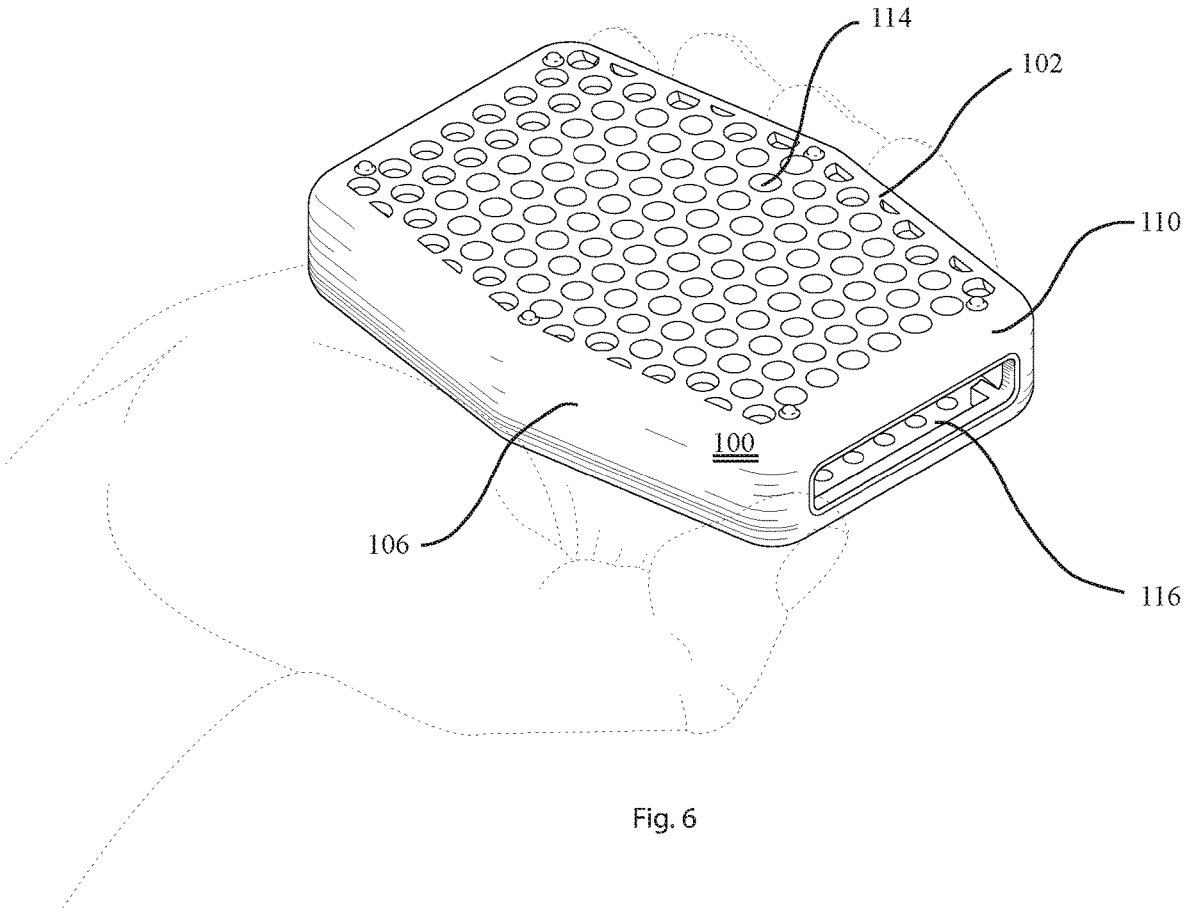
FIG. 6 is an isometric view of the elastic soap sleeve similar to FIG. 1, showing proportions in relation to a human hand.
Figure 7:
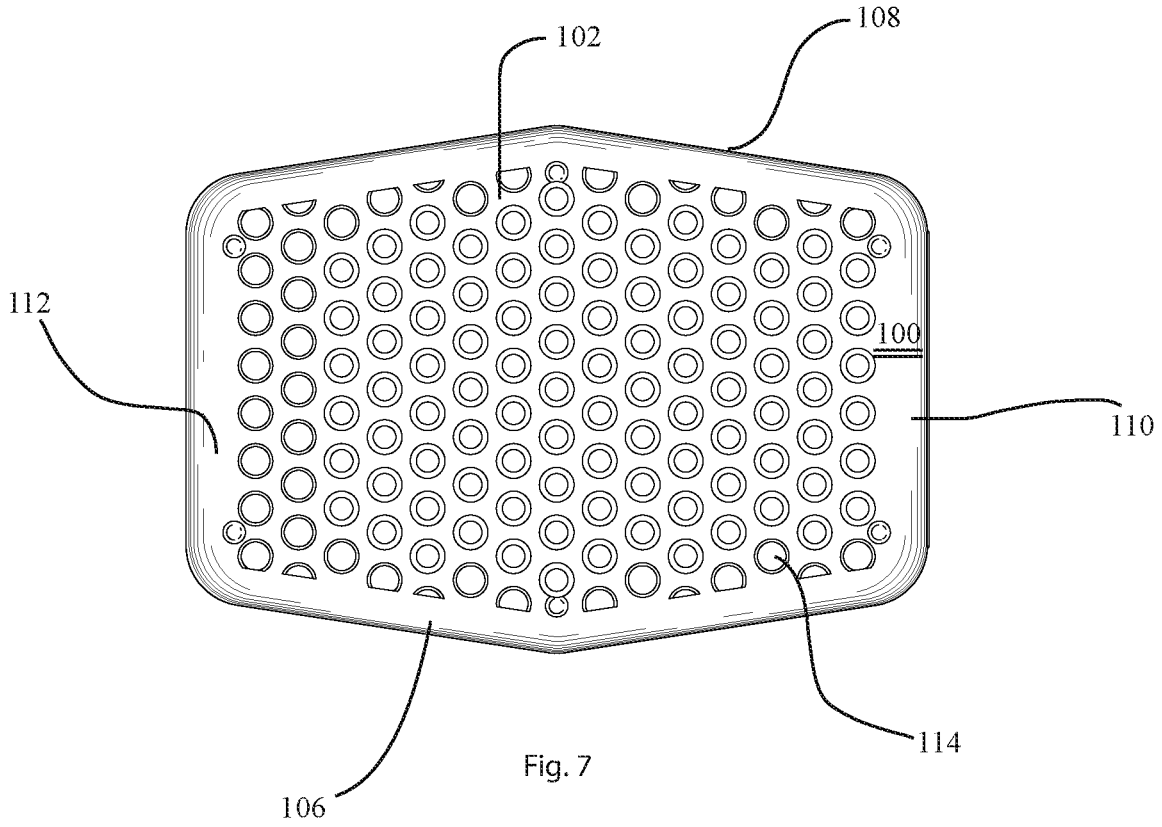
FIG. 7 is a bottom view of the soap sleeve of FIG. 1.
Figure 8:
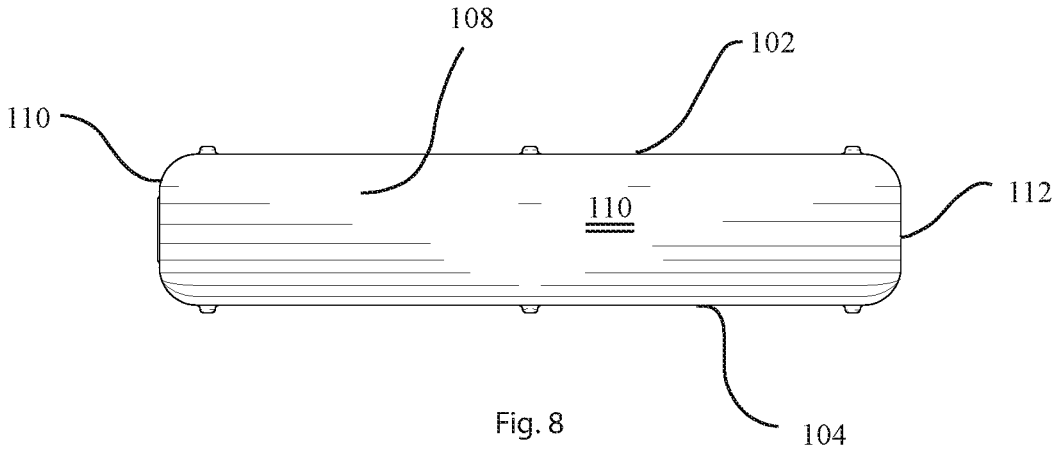
FIG. 8 is a side view of the soap sleeve of FIG. 1.

FIGS. 1, 5, and 6 also shows an opening 116, which allows that soap bar or other soap cake to enter the container 100. This opening 116 is elastic and will provide resistance to the internal soap cake to avoid the soap cake slipping out.

In an additional embodiment, bristles may also be present on the top 102 and bottom 104 surfaces of the container 100 to enhance to the invention's production of suds and efficiency of exfoliation.

The system also provides for a method of using a soap sleeve 100 to increase exfoliation and reduce the rate at which the soap is depleted. In the method, a user provides a soap sleeve 100 constructed as an elastic sleeve 100 for use with a bar of soap to limit the surface area of the soap that is exposed, and reduce the rate of shrinkage of the bar of soap. The sleeve comprises a container 100 of elastic form-fitting material, wherein said container 100 has a top 102 and a bottom 104 and an elastic opening 116 for insertion of a soap cake. The elastic form-fitting material is configurable for dimensions adaptable to the shape of an underlying soap cake. The soap sleeve 100 also includes a plurality of apertures 114 in the elastic material of the top 102 and bottom 104 of the container 100 to provide atmospheric communication through the elastic sleeve 100 to an inserted soap cake's exposed surface areas, while also creating a barrier for unexposed areas of said soap cake.

Once this sleeve 100 is provided, a user will insert a soap cake through the opening 116 on the front 110 side of the soap sleeve 100. The walls of the soap sleeve 100 expand to accommodate the soap cake, and the material forms a tight fit around the soap cake, sealing off the portions that are not exposed by the apertures 114.

A user may then use the soap sleeve 100 by rubbing the filled soap sleeve 100 on his or her skin to generate suds. This is accomplished by the interaction of the soap cake and water in the apertures 114. The slightly abrasive surface created by the apertures 114 also enhances exfoliation of dead skin.

The apertures 114 must be configured to a sufficient depth to be both shallow enough to allow the interaction to form suds, and thick enough to provide structural support to avoid ripping the elastic material of the soap sleeve 100.

Through the repetition of this process, a user will find that the rate of depletion of the volume and contents of the soap cake will reduce, and the soap cake will hold its volume longer than use of a soap cake without a soap sleeve 100.

While there has been shown and described above the preferred embodiment of the instant invention it is to be appreciated that the invention may be embodied otherwise than is herein specifically shown and described and that, within said embodiment, certain changes may be made in the form and arrangement of the parts without departing from the underlying ideas or principles of this invention as set forth in the Claims appended herewith.

I claim:

1. An elastic sleeve for use with a bar of soap to limit the surface area of the soap that is exposed, and reduce the rate of shrinkage of the bar of soap, the sleeve comprising:

a container of elastic form-fitting material;

said container having a top and a bottom;

said container having an elastic opening for insertion of a soap cake;

said elastic form-fitting material configurable for dimensions adaptable to the shape of an underlying soap cake, wherein said elastic form-fitting material keeps a tight periphery to a soap cake to stop contact of water with a surface of said soap cake where said elastic form-fitting material does not have an aperture;

a plurality of resilient apertures in said elastic form-fitting material of said top and bottom of said container to provide atmospheric communication through the elastic sleeve to an inserted soap cake's exposed surface areas, wherein said elastic form-fitting material can flex and contract to provide a tight, form-fitting periphery around said soap cake so that the soap cake does not get wet beyond areas exposed to the resilient apertures; and said form-fitting material creating a barrier for unexposed areas of said soap cake.

2. The elastic sleeve as recited in claim 1, wherein the elastic material comprises silicone.

3. The elastic sleeve as recited in claim 1, wherein said plurality of resilient apertures exist on both a bottom surface and a top surface.

4. A method of using a soap sleeve to increase exfoliation, limit the exposed surface area of a soap cake, and reduce the rate at which the soap is depleted, the method comprising:

providing an elastic soap sleeve defined by a container of elastic form-fitting material, wherein said container has a top and a bottom and an elastic opening for insertion of a soap cake, wherein the elastic form-fitting material of the container is configurable for dimensions adaptable to the shape of an underlying soap cake;

including a plurality of resilient apertures in the elastic material of the top and bottom of the container to provide atmospheric communication through the elastic sleeve to an inserted soap cake's exposed surface areas, while also creating a barrier for unexposed areas of said soap cake;

inserting a soap cake through the elastic opening on a front side of the soap sleeve, wherein walls of the soap sleeve expand to accommodate the soap cake;

allowing the elastic material to form a tight fit around the soap cake; and allowing the elastic material contract and seal off portions of the soap cake's surface that are not exposed by the resilient apertures.

5. The method as recited in claim 4, further comprising:

configuring said resilient apertures to a sufficient depth that is shallow enough to allow the interaction to form suds, and thick enough to provide structural support to avoid ripping the elastic material of the soap sleeve.

6. The method as recited in claim 5, further comprising:

rubbing the soap sleeve on a user's skin to generate suds, thereby also creating an enhanced exfoliation effect by using the abrasive surface to remove dead skin; and influencing an interaction of the soap cake and water in the resilient apertures.

* * * * *